United States Patent [19]

Himmelmann et al.

[11] Patent Number: 4,603,102

[45] Date of Patent: Jul. 29, 1986

[54] PHOTOGRAPHIC SILVER HALIDE RECORDING MATERIAL WITH CELLULOSE DICARBOXYLIC ACID SEMIESTER PARTICLES IN OUTER LAYER

[75] Inventors: Wolfgang Himmelmann; Fritz Nittel, both of Leverkusen; Rudolf Meyer; Lothar Rosenhahn, both of Cologne, all of Fed. Rep. of Germany

[73] Assignee: Agfa-Gevaert Aktiengesellschaft, Leverkusen, Fed. Rep. of Germany

[21] Appl. No.: 748,965

[22] Filed: Jun. 26, 1985

[30] Foreign Application Priority Data

Jul. 6, 1984 [DE] Fed. Rep. of Germany ..... 3424893

[51] Int. Cl.[4] ..... G03C 1/32

[52] U.S. Cl. ..... 430/523; 430/539; 430/950

[58] Field of Search ..... 430/523, 539, 950, 961

[56] References Cited

U.S. PATENT DOCUMENTS 4,514,131 6/1985 Himmelmann et al. ..... 430/950

*Primary Examiner*—Jack P. Brammer

*Attorney, Agent, or Firm*—Connolly and Hutz

[57] ABSTRACT

The photographic silver halide recording material contains particles of a hydroxyalkyl-alkyl cellulose dicarboxylic acid semiester having a particle size of from 0.5 to 8 μm and a particle size distribution of up to ±2 μm dispersed in a hydrophilic colloid in at least one of its outermost layers.

5 Claims, 6 Drawing Figures

Figure 1:
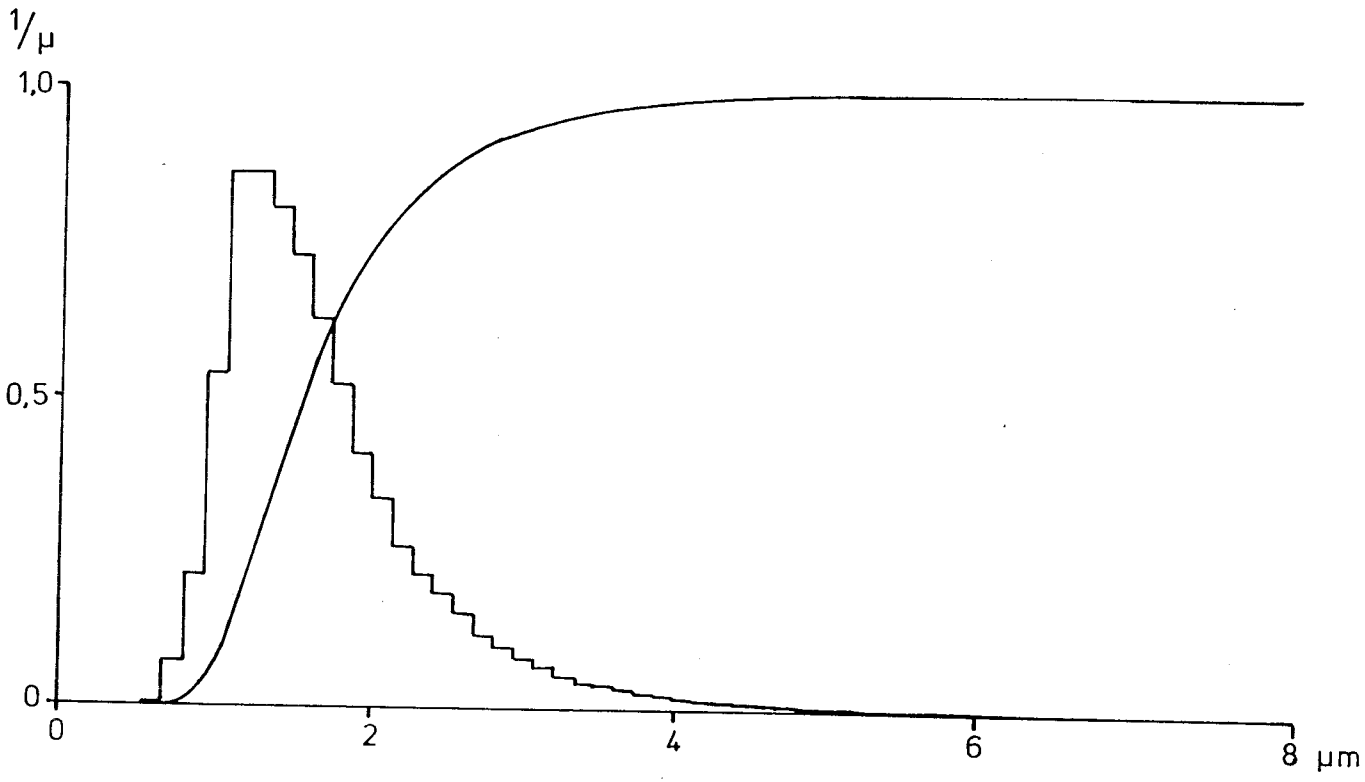

PHOTOGRAPHIC SILVER HALIDE RECORDING MATERIAL WITH CELLULOSE DICARBOXYLIC ACID SEMIESTER PARTICLES IN OUTER LAYER

This invention relates to a photographic silver halide recording material in which particles of a cellulose ether dicarboxylic acid semiester smaller than 10 μm which are soluble in alkaline processing liquids are dispersed in a hydrophilic colloid in an outer transparent layer applied to the front and/or back of the material.

The hydrophilic colloids normally contained in the outer layers of photographic silver halide recording materials, such as gelatine, increase the tackiness of the recording materials at elevated temperatures and high atmospheric moisture contents so that these recording materials tend to stick together, for example when they are packaged in a stack. This tendency of different parts of the recording material to stick together and of the recording material to stick to other materials with which they are brought into contact gives rise to numerous difficulties both inside the camera and in the course of the preparation, processing, projection or storage of the recording material.

It is known to incorporate finely powdered inorganic compounds such as silicon dioxide, magnesium oxide, titanium dioxide or calcium carbonate or organic compounds such as polymethyl-methacrylate or cellulose acetate propionate in the outer layers of photographic materials for the purpose of "matting" these surfaces to reduce their tackiness and thus overcome the aforesaid difficulties. This delustering or matting has, however, various disadvantages. Thus, for example, it is not possible to obtain a homogeneous outer layer incorporating such matting materials since these finely powdered constituents tend to agglomerate in the coating solution. In addition, recording materials containing such finely powdered materials in their outer layer are more easily damaged and are more difficult to transport inside a camera or projector since their surface does not slide so easily. Moreover, the finely powdered materials in the outer layer reduce the transparency of the photographic material after processing and increase the graininess of the image.

DE-OS No. 2 758 767 discloses a light-sensitive photographic material which has an outer light-insensitive layer of gelatine containing colloidal silica particles measuring 7 to 120 nm and a polymer latex consisting of particles measuring 30 to 80 nm. This gelatine layer increases the resistance to breakage and the dimensional stability of the photographic material.

Photographic materials equipped with such a layer have, however, the disadvantage that the additives reduce the transparency of the layers and moreover, when the materials are rolled up it is impossible to prevent the formation of sensitometrically disadvantageous contact patches, especially at temperatures of about 35° to 40° C. and relatively high atmospheric moisture contents (e.g. above 85% r.h.).

Various processes are known for producing fine grained materials which have a matting effect. Thus, for example, polymer particles having a particle diameter from about 5 to about 0.01 μm can be obtained by a process of emulsion polymerisation if the quantity of emulsifier (surface active agent), the polymerisation temperature and the conditions of stirring are suitably controlled. The procedure is described, for example, by H. Reinhard, "Dispersionen synthetischer Hochpolymerer", Part II, page 3 et seq, Springer Verlag, or by F. Hölscher in Part I, page 31 et seq of the same publication. The particles obtained by this procedure, however, have a considerable lack of uniformity of their particle size, their average size differing by at least 2 μm. Mechanical pulverization followed by sorting the particles according to size results in a product consisting of polymer particles which have a wide particle size distribution and are not spherical but completely irregular in shape.

Spherical polymer particles may be produced by dissolving a polymer in an organic solvent which is immiscible with water and spraying the solution from a fine nozzle into an aqueous medium under high pressure. No suitable economical process is as yet available for producing uniform polymer particles having a particle size within the range of from 1 to 10 μm.

Finely divided polymer particles may also be obtained by a process of dispersion. This is carried out by dissolving one or more polymers in a solvent which is either insoluble in water or substantially immiscible with water and has a lower boiling point than water or combines with water to form an azeotropic mixture which has a lower boiling point than water. The polymer solution is dispersed in the form of droplets in an aqueous medium used as dispersing agent, the viscosity and surface tension being suitably adjusted and the solvent being subsequently removed from the droplets, which then form fine polymer particles. These particles may subsequently be separated in the form of a powder by centrifuging and drying (DE-OS No. 2 522 692).

Preformed water-insoluble polymer particles having a relatively narrow particle size distribution and suitable for use as matting agents for photographic layers are obtainable by a suspension copolymerisation of maleic acid anhydride and 1-olefines (DE-OS Nos. 2 501 124, 1 919 822 and 3 144 793). The particles obtained by this process are sufficiently uniform in their particle size but they are insoluble in alkalies and therefore remain on the surface after the photographic material has been processed and thus increase the graininess of the light-sensitive material.

There has therefore been no lack of attempts to find alkali-soluble polymer particles which are removed from the surface when the photographic material is processed in alkaline processing fluids. See in this connection U.S. Pat. No. 2,322,037, GB-PS No. 878 520, U.S. Pat. No. 4,094,848, U.S. Pat. No. 4,142,894, GB-PS No. 2 012 978, GB-PS No. 1 055 713 and DE-OS No. 3 331 542.

The known alkali-soluble graft polymers based on methacrylic acid and methyl methacrylate on styrene-maleic acid semiester copolymers as graft basis have the disadvantage that when no gelatine is present in the casting mixture, they begin to dissolve at pH-values of about 6.2 to 6.5. Since it is mainly the small particles which dissolve, the entire particle size distribution changes and it is therefore necessary to use larger quantities. The viscosity of the casting solution then increases and must be continuously monitored. This premature solution of the particles is particularly disadvantageous when the casting solution contains additives such as silica sols which are alkaline both due to their method of preparation and for the purpose of stabilizing the solutions. The known alkali-soluble matting particles therefore give rise to difficulties during casting and drying since the particles may begin to dissolve at the pH of the emulsion layers. If the solutions have a slight buffering capacity, the alkali soluble matting particles are generally protected by the fact that the pH continuously falls as the particles dissolve and may finally settle at a particular value which is suitable for the particles. If, however, the casting solutions or the layers of the photographic material have a pH above 6.5 and the buffering capacity is high, then the particles progressively dissolve without the above mentioned advantageous pH value being reached, with the result that the desired matting effect is not obtained.

It is an object of the present invention to develop a photographic material in which the outer layers have no tendency to tackiness and have a high gloss and high transparency after the photographic material has been processed and which are obtained from casting solutions which are stable at pH values up to 7.

The present invention relates to a photographic silver halide recording material in which particles smaller than 10 μm which are soluble in alkaline processing liquids are dispersed in a hydrophilic colloid contained in a transparent outer layer applied to the front and/or back of the recording material, characterised in that the layer contains, dispersed therein, from 10 to 500 mg/m$^2$ of spherical transparent particles of a hydroxyalkylalkyl cellulose dicarboxylic acid semiester having a particle size of from 0.5 to 8 μm and a particle size distribution of up to ±2 μm.

The hydroxyalkyl-alkyl cellulose dicarboxylic acid esters, hereinafter briefly referred to as "cellulose derivatives", used in the outer layer of the recording material according to the invention are insoluble in casting solutions at pH values below 7 even if the solutions contain gelatine but they readily dissolve at pH values above 8. The increase in solubility occurs within a narrow pH interval above pH 7.2.

The cellulose derivatives employed according to the invention correspond to the following general formula $$R_m{}^1R^2{}_nR^3{}_pA$$

wherein

A denotes a glucose residue of the cellulose structure, $R^1$ denotes a hydroxyalkyl group having 2 to 4 carbon atoms, $R^2$ denotes an alkyl group having 1 to 3 carbon atoms, $R^3$ denotes the monoacyl residue of a benzene dicarboxylic acid or of such an acid in a partially or completely hydrogenated form, m=0.2–1.0, n=0.8–2.0 and p=0.5–1.5 where m≠n≠p and the sum of m+n+p is at the most 3 (the figures denote mol).

Examples of the above mentioned dicarboxylic acid monoesters include esters of phthalic acid, of tetrahydrophthalic acid and of hexahydrophthalic acid. In the cellulose derivatives according to the invention, these dicarboxylic acid monoesters are esterified at one of their carboxyl groups with mixed ethers of cellulose, e.g. hydroxyethyl-methyl cellulose, hydroxypropyl-methyl cellulose, hydroxyethyl-ethyl cellulose or hydroxypropyl-ethyl cellulose. The dicarboxylic acid monoester content of the cellulose derivatives should be adjusted according to the hydrophobicizing effect of the cellulose ethers so that the desired solubility in alkaline solution is obtained. The compounds may easily be prepared by the process described in DE-OS No. 2 841 164.

The cellulose derivatives are employed in a quantity of from 10 to 500 mg/m$^2$, preferably from 80 to 150 mg/m$^2$ per layer.

The following are examples of particularly suitable compositions for the cellulose derivatives:

Compound A 17.4% by weight of methoxy groups
7.2% by weight of hydroxypropoxy groups
35.0% by weight of hexahydrophthaloyl groups.

The term "phthaloyl" is used here and in the following for the group —CO—$C_6H_4$—COOH.

Compound B 18.0% by weight of methoxy groups
9.0% by weight of hydroxypropoxy groups
35.0% by weight of phthaloyl groups.

The cellulose derivatives introduced into the outer layers of the photographic material may have so-called stabilizers added to them.

The compounds used as stabilizers counteract any tendency of the cellulose derivatives to dissolve during the period of digestion. The known oil formers with free carboxyl groups used for the preparation of silver halide emulsions are found to be particularly suitable for this purpose.

A quantity of 1 to 30% by weight of stabilizing compound, based on the cellulose derivative, is in all cases sufficient for achieving the desired effect.

Compounds from the above mentioned group which are suitable as stabilizers have been described, for example, in DE-PS No. 1 772 192. The preparation of these compounds is well known and may be carried out, for example, by the reaction of monoalkylated cyclic carboxylic acid anhydrides with alcohols or amines.

The following compounds are given as examples of highly suitable stabilizers:

1. $CH_3-(CH_2)_3-\underset{\underset{C_2H_5}{|}}{CH}-COOH$

2. $CH_3-(CH_2)_{10}-COOH$
3. $CH_3-(CH_2)_{12}-COOH$
4. $CH_3-(CH_2)_{14}-COOH$
5. $CH_3-(CH_2)_{16}-COOH$
6. $CH_2=CH-(CH_2)_8-COOH$

7. $\begin{array}{l} HC-(CH_2)_7-CH_3 \\ \| \\ HC-(CH_2)_7-COOH \end{array}$

In the formulae given below, R represents one of the monounsaturated aliphatic groups —$C_{12}H_{23}$, —$C_{15}H_{29}$ or —$C_{18}H_{35}$ the formation of which may be explained in terms of a repeated addition of propylene.

8. 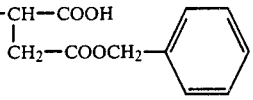
9. 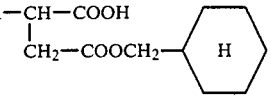
10. 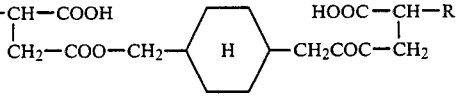
11. 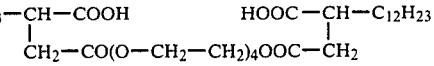
12. 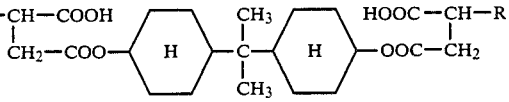
13. 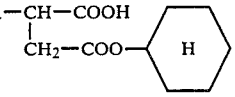
14. 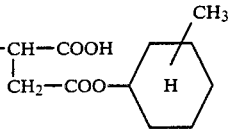
15. 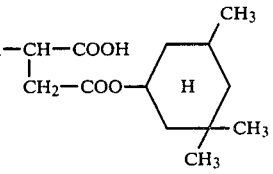
16. 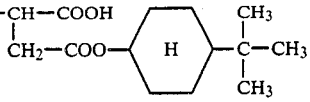
17. 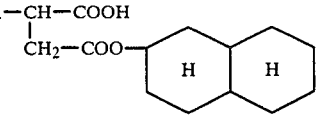
18. 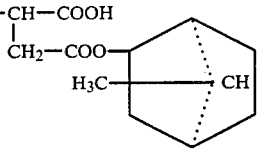
19. 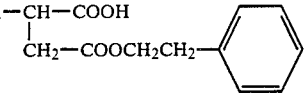
20. 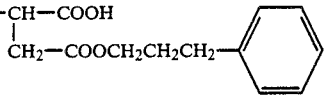
21. 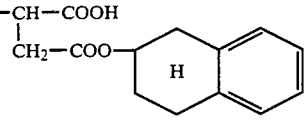
22. 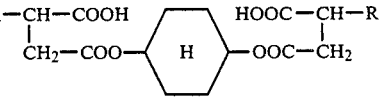
23. 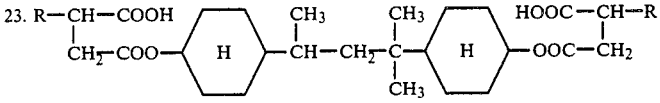
24. 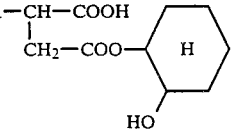
25. 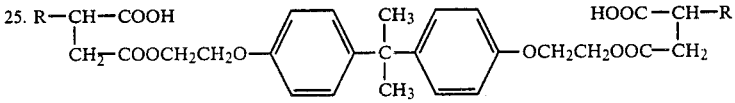
26. 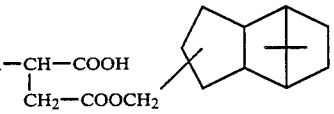
27. 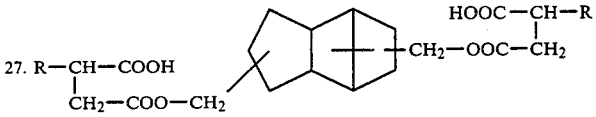
28. 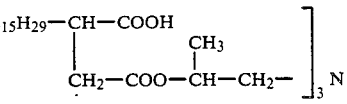
29. 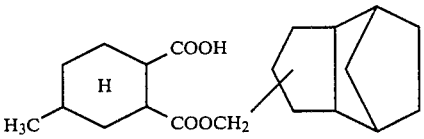
The stabilizers may be added to the casting solutions for the outer layers prior to the process of dispersion, using quantities of from 1 to 30% by weight, preferably from 2.5 to 10% by weight, based on the solids content of the cellulose derivative.

The preparation of dispersions of cellulose derivatives in gelatine is described below.

Dispersion 1

Particles of hydroxypropyl-methyl cellulose-hexahydrophthalic acid semiesters in gelatine.

1000 ml of water are introduced into a 5 l glass beaker. 100 g of gelatine are added with stirring. The gelatine is left to swell for 30 minutes and then melted.

100 g of hydroxypropyl-methyl cellulose-hexahydrophthalic acid semiester (Compound A) are dissolved in 900 ml of methylene chloride, and 30 ml of a 10% by weight solution of a fluorotenside in ethanol are stirred in. After filtration, this solution is introduced into the gelatine solution. The mixture is then vigorously dispersed for 2 minutes, using a mechanical mixer.

The particle size obtained is from 1 to 4 μm. The excess methylene chloride is then removed at 40° C. with slow stirring and the dispersion is filtered through a filter having a pore size of 10 μm and left to solidify in a cooling dish. 1200 g of dispersion contain about 100 g of cellulose derivative. The particle size varies from 1 to 4 μm. The particle size distribution is represented in FIG. 1.

In FIGS. 1, 2, 4 and 5, the frequency distribution of the particle diameters of the given cellulose derivatives is represented as the frequency density (1/μ) corresponding to the individual particle diameters (μm).

In addition, each figure contains the corresponding summated frequency curve (integral distribution).

Dispersion 2

Hydroxypropyl-methyl cellulose hexahydrophthalic acid semiester and stabilizer No. 12 dispersed in gelatine.

A solution I is prepared from
985 ml of water
15 g of gelatine and
3.2 g of phenol.

Solution II having the following composition is prepared separately:
25 g of hydroxypropyl-methyl cellulose-phthalic acid semiester (Compound B),
250 g of ethyl acetate,
2.5 g of stabilizer No. 12 (50% by weight in ethanol) and
0.8 g of dibutyl naphthalene sulphonate (75% by weight in water).

Solution II is emulsified in Solution I. The ethyl acetate is then evaporated off at reduced pressure and 367 g of a 15% by weight aqueous gelatine solution is added. After mixing, the dispersion is solidified at 5° C.

The particle size lies within the range of from 1 to 4 μm.

Figure 2:
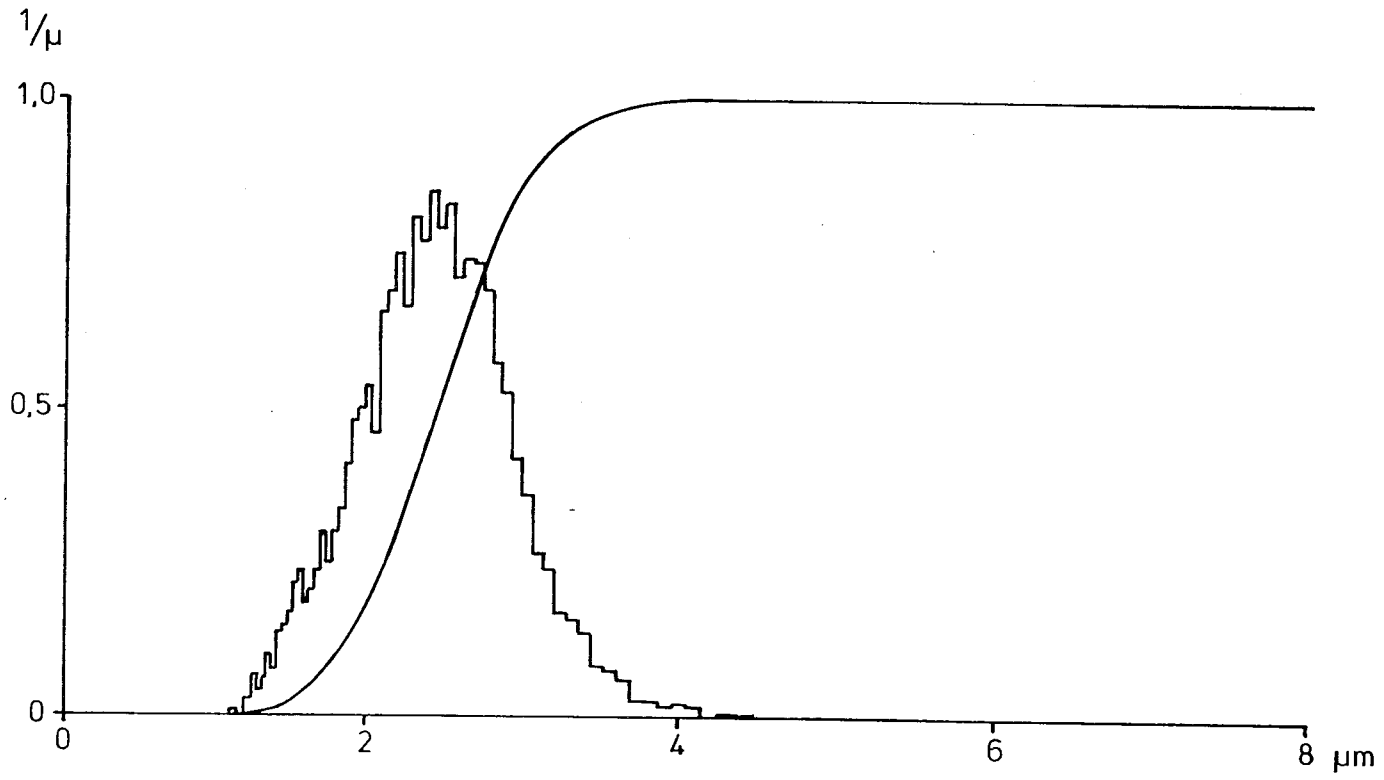

The particle size distribution is represented in FIG. 2.

Figure 3:
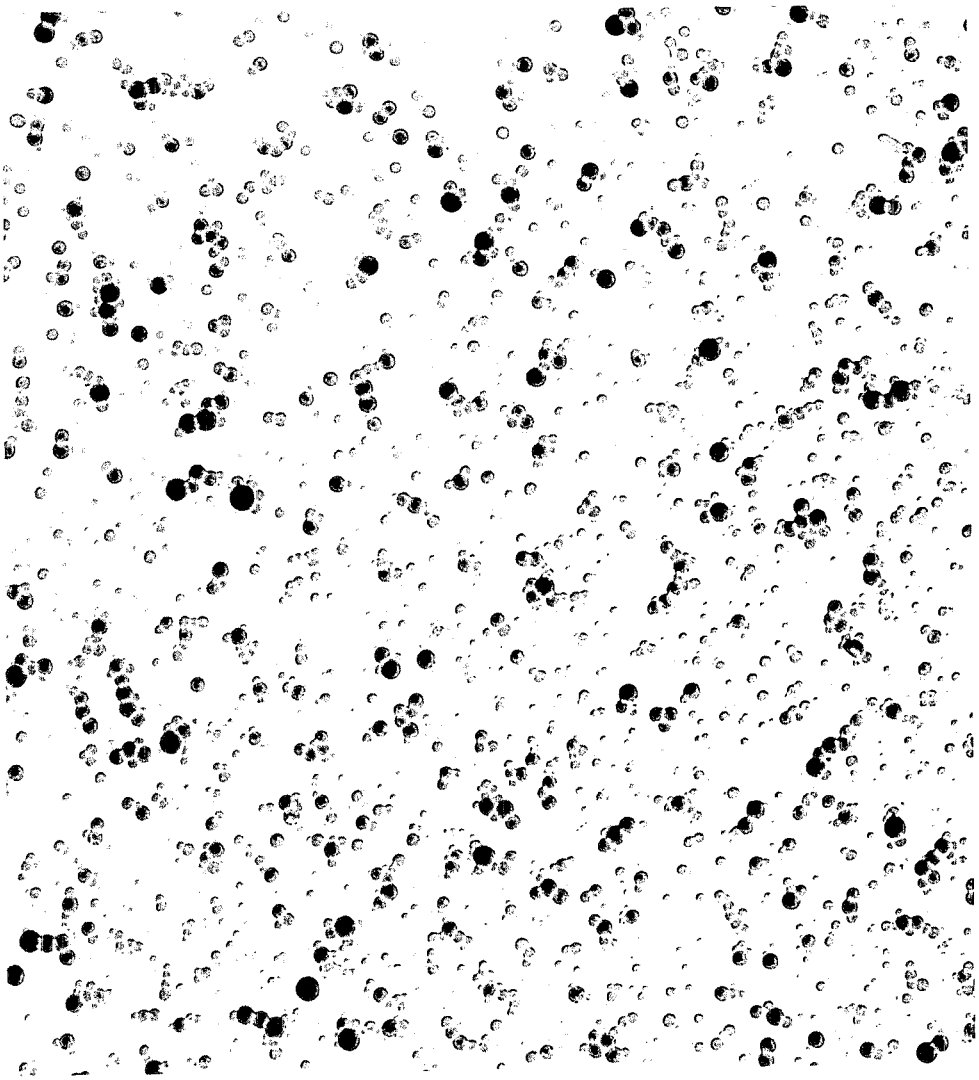

FIG. 3 is an electron microscopic image of the cellulose derivative particles at 10,000 times magnification.

Dispersion 3

Hydroxypropyl-methyl cellulose hexahydrophthalate (Compound A) and stabilizer No. 12 in gelatine A mixture of
0.25 kg of cellulose derivative Compound A,
0.025 kg of stabilizer No. 12,
2.5 kg of ethyl acetate and
0.008 kg of the compound corresponding to the formula

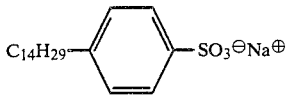

Figure 4:
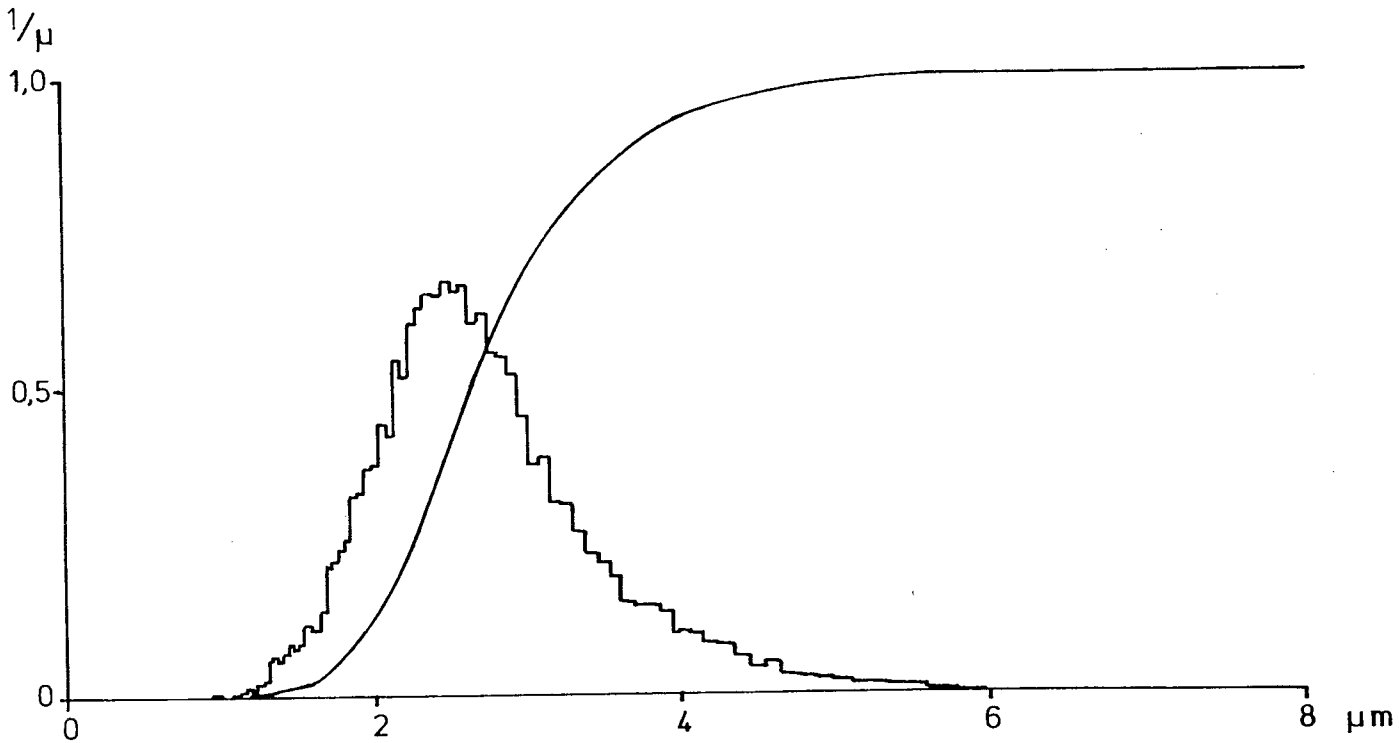

(75% by weight in water) as wetting agent
is emulsified in a solution of
9.85 l of water,
0.15 kg of gelatine and
0.032 kg of phenol
at 35° C. in an emulsifying machine. After evaporation of the volatile organic constituents, there are obtained 10.3 kg of dispersion, to which 3.67 kg of a 15% by weight aqueous gelatine solution are then added. The complete dispersion contains 0.25 kg of cellulose derivative. The particle size lies in the range from 1 to 6 μm. The particle size distribution is shown in FIG. 4.

Dispersions 4–9

Particles of hydroxypropylmethyl cellulose hexahydro phthalate (Compound A) and various stabilizers.

Additional dispersions are prepared by the methods given for Dispersion 3 but using the stabilizers shown in the following Table instead of stabilizer 12.

| Dispersion | Stabilizer No. |
|---|---|
| 3 | 12 |
| 4 | 28 |
| 5 | 10 |
| 6 | 11 |
| 7 | 9 |
| 8 | 29 |
| 9 | 26 |

Figure 5:
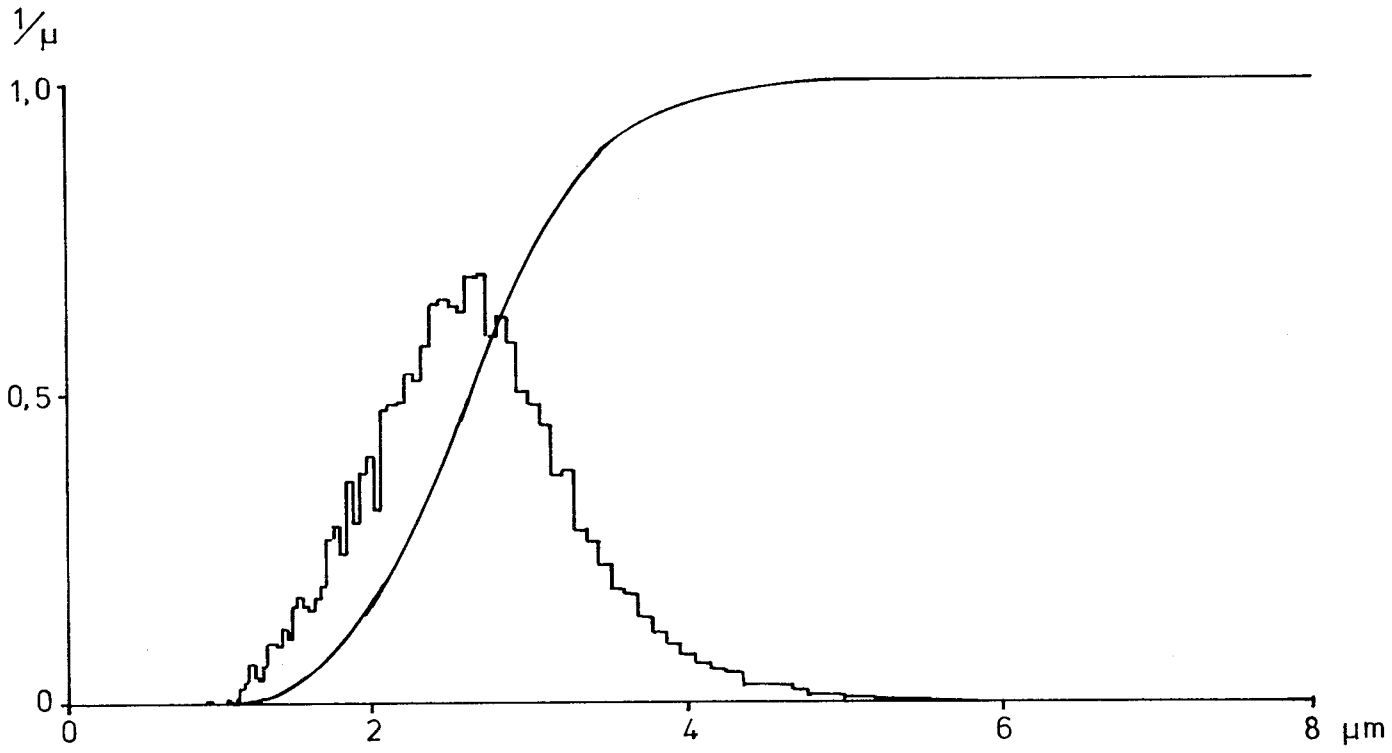

The particle size distributions and the particle sizes of the cellulose derivative of the above dispersions are represented in FIG. 5.

The cellulose derivative particles of the dispersions are spherical and transparent. They are obtained in particle sizes of 1–7 82m, preferably 1–5 μm.

Since it is an important precondition for using these particles that they must be both insoluble in acid media, in particular in the pH range of from 6 to 7, and readily and rapidly soluble in the alkaline medium of the photographic developer solutions (pH above 8), the particles must conform to a particular molecular weight and carboxyl group content in order that they may fulfil these criteria.

In no case is it suitable to use cross-linked or cross-linking products, that is to say the cellulose derivative must be free from microgels. This condition may be tested by dissolving the particles in a 1% aqueous $Na_2CO_3$ solution and determining the microgel content of the solution by means of an ultracentrifuge.

The dispersions obtained as described above may be distributed in aqueous solutions of hydrophilic colloids with any wetting agents. The following compounds, for example, may be used as hydrophilic colloids: Proteins such as gelatine, gelatine derivatives such as acetylated gelatine, phthaloyl gelatine or succinyl gelatine, albumin, casein, gum arabic, agar-agar, alginic acid, cellulose derivatives such as alkyl esters of carboxymethyl cellulose, preferably the methyl or ethyl esters, hydroxyethyl cellulose, carboxymethyl cellulose, synthetic polymers such as polyvinyl alcohol, polyvinyl pyrrolidone, polyacrylamide, salts of polyacrylic acid, salts of polymethacrylic acid, salts of polymaleic acid, salts of polystyrene sulphonic acid, preferably the sodium or potassium salts or copolymers containing at least one of the monomers of the above mentioned polymers. Among these hydrophilic colloids, amphoteric polymeric electrolytes such as gelatine, gelatine derivatives, casein and other protein compounds have a particularly pronounced effect. The hydrophilic colloids may also be used singly or in the form of a combination. Gelatine, gelatine derivatives, casein and other protein compounds are preferred colloids. The colloid is suitably used in a quantity from about 1 to about 15% by weight, preferably from 5 to 10% by weight, based in each case on the weight of the dispersion.

From 0.1 to 1% by weight of surface active agents, based on the weight of water used, may be added to the aqueous solutions containing the dispersion. Examples of suitable surface active agents include saponin and other compounds of natural origin, non-ionic surface active agents such as polyalkylene oxides, glycerol compounds such as monoglycerides or glycidol compounds, or anionic surface active agents containing one or more acid groups, e.g. one or more carboxylic acid, sulphonic acid, phosphoric acid, sulphonic acid ester or phosphoric acid ester groups. Particularly suitable surface-active agents are described in U.S. Pat. Nos. 2,271,623; 2,240,472; 2,288,226; 2,676,122; 2,676,924; 2,676,975; 2,691,566; 2,721,860; 2,730,498; 2,742,379; 2,739,891; 3,068,101; 3,158,484; 3,201,253; 3,210,191; 3,294,540; 3,415,649; 3,441,413; 3,442,654; 3,475,174 and 3,545,974; in DE-OS No. 1 942 665 and in GB Pat. Nos. 1 077 317 and 1 198 450 as well as in "Kaimen Kassei Zai no Gosei to Sono Ohyo" (Synthesis and Application of Surface Active Agents) by Ryohei Oda et al (published by Maki Publishing Co., 1964), "Surface Active Agents" by J. W. Perry and A. M. Schwartz (published by Interscience Publications Inc., 1958), "Encyclopedia of Surface Active Agents", Volume 2, by J. P. Sisley (published by Chemical Publishing Co., 1964), "Kaimen Kassei Zai Binran (Surfactants Encyclopedia)", 6th Edition (published by Sangyo Tosho Co., Dec. 20, 1966), and the like. Wetting agents containing fluorine may also be used, for example those described in DE-OS No. 1 961 638.

These surface-active agents may be used alone or in the form of combinations, and particularly suitable compounds are those containing an $OSO_3M$ group, such as sulphonate esters of ordinary alcohols, corresponding to the general formula R—O—$SO_3M$ or R—$(OCH_2CH_2)n$—$OSO_3M$ (wherein R denotes an alkyl group having 8 to 30 carbon atoms, M denotes an alkali metal ion or ammonium ion and n represents a positive integer of up to 20) and alkylbenzene-sulphonic acid compounds corresponding to the general formula

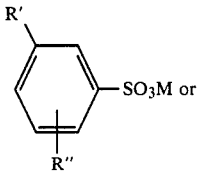

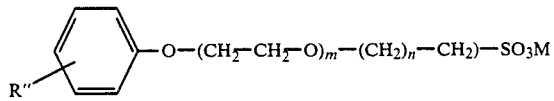

wherein R' represents hydrogen or an alkyl group with 1 to 18 carbon atoms, R'' represents an alkyl group with 1 to 18 carbon atoms, M represents an alkali metal ion or ammonium ion, m represents a positive integer with a value from 0 to 20 and n represents the number 3 or 4.

The dispersions containing the cellulose derivatives may either be added directly to the photographic casting solutions for the outer layer or the particles of cellulose derivative may first be isolated as a solid residue in the form of a paste by centrifuging. The cellulose derivatives are photographically inert and do not affect the graininess of the recording material if they are added to the layers in suitable quantities in the range of 10 to 500 $mg/m^2$.

The advantageous surface roughening obtained by means of the cellulose derivatives according to the invention may be further improved by adding colloidal silica in the form of a hydrosol to the casting composition containing the cellulose derivatives before it is applied to the surface of the photographic material. Satisfactory results are obtained with commercial hydrosols having a particle size of from 50 to 150 nm, which may be added to the casting composition in quantities of from 0.5 to 2 parts by weight, based on 1 part by weight of the hydrophilic colloid. The silica particles introduced with the hydrosol differ from the cellulose derivatives according to the invention by orders of magnitude and therefore do not participate in the specific action of the latter. The contribution of the silica particles in the overall effect is simply that they help to suppress the in any case only slight tendency of the surface layers produced by the process according to the invention to form glossy or coloured patches.

The casting compositions used for preparing the outer layers according to the invention may, if desired, contain further additives which have no influence on the desired surface characteristics. The following are examples: Very fine grained ($\phi < 0.1$ μm) latices of hard polymers such as polystyrene or polymethylmethacrylate; very fine grained (particle diameter $< 0.1$ μm) latices of soft homo- and copolymers such as polyethyl acrylate or butyl polyacrylate-ethylacrylate or latices of polyether or polyester polyurethanes as described in "Research Disclosure", December 1978, Industrial Opportunities Ltd., Hampshire, UK, page 27 (XII A); conductivity increasing compounds as described in "Research Disclosure", December 1978, page 27 (XIII A); hardeners as described in "Research Disclosure", December 1978, page 26under (X); casting auxiliaries as described in the same "Research Disclosure" number under (XI); antiblocking agents such as silicone oil dispersions, and substances which increase the viscosity of the casting solution.

Advantageous results are obtained with homo- or copolymers having a particle size of less than 0.1 μm and a glass transition temperature of at least 40° C. The polymers may be added to the layers in quantities of up to 50% by weight, based on the dry content of hydrophilic colloid.

The outer layers according to the invention may be used to supply hardener to the gelatine layers of the photographic material. In this known method of hardening by applying a surface coating of hardener, the hardener enters the deeper lying layers by diffusion. This method enables hardening to be achieved by a single step, e.g. in a colour photographic multilayered material. The hardeners used for this method are usually the so-called instant hardeners. Examples of such hardeners include N-carbamoyl- and N-carbamoyloxypyridinium compounds (U.S. Pat. No. 3,880,665), N-carbamoylpyridinium compounds containing sulpho groups, in the form of the free betaines or their metal salts (U.S. Pat. No. 4,036,952), 2-alkoxy-N-carboxydihydroquinoline esters (U.S. Pat. No. 4,013,468), isoxazolium salts U.S. Pat. No. 3,321,313) and carbodiimides (DE-PS No. 1 148 446 and DE-OS No. 2 439 553).

The cellulose derivatives according to the invention may advantageously be used in the protective or surface layers of black-and-white photographic materials or colour photographic materials and in the so-called non-curling layers of roll films, miniature films and sheet films.

EXAMPLE 1

The following casting compositions are made up for the preparation of a protective surface layer (percentages are percentages by weight unless otherwise indicated):

400 g of 15% gelatine solution,
2,800 g of water (deionized),
80 g of wetting agent corresponding to the formula $$C_8F_{17}SO_3^{\ominus}[N(C_2H_5)_4]^{\oplus}$$

4% in water.

The cellulose derivatives are stirred into this composition in the form of their dispersions.

Shortly before application of the casting composition, 2,000 g of a 10% by weight aqueous solution of hardener corresponding to the formula

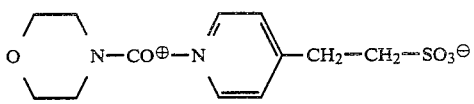

are added.

Wet application of the casting compositions: 50 g/m$^2$; pH: 6.5–7.0.

The following casting compositions are prepared in accordance with the above formulation:

1-A: Comparison sample without cellulose derivative according to the invention
1-B: Casting solution containing 50 g of Dispersion 1
1-C: Casting solution containing 225 g of Dispersion 2
1-D: Casting solution containing 225 g of Dispersion 3
1-E: Casting solution containing 225 g of Dispersion 4.

In addition, comparison samples are prepared, consisting of casting compositions which instead of containing the cellulose derivatives according to the invention contain known matting agents, which are not according to the invention, in each case in a quantity of 4 g:

| | | |
|---|---|---|
| 1-F | Polymethylmethacrylate particles (corresponding to U.S. Pat. No. 2 322 037) | ∅ 3–8 μm |
| 1-G | Polytetrafluoroethylene particles | ∅ 2–6 μm |
| 1-H | Calcium carbonate | ∅ 1–5 μm |
| 1-I | Acetyl cellulose | ∅ 3–8 μm. |

The casting compositions are poured as uppermost covering layer (wet application 50 g of composition per m$^2$) on an unhardened colour negative film, using a casting machine, and the layer is dried at 25° C. and 60% relative humidity. The covering layers form a coating weighing 0.6–0.7 g/m$^2$ when dry.

The colour negative film used has a conventional arrangement of layers. A red-sensitized silver halide layer containing emulsified cyan colour coupler, an intermediate layer, a green-sensitized silver halide layer containing magenta coupler, a yellow filter layer and a blue sensitized silver halide layer containing yellow coupler are applied in succession to a cellulose triacetate support.

The intermediate layers consist of gelatine and a casting auxiliary, and the yellow filter layer in addition contains yellow colloidal silver. The layers containing silver halide have a thickness of from 5 to 6 μm, the intermediate layer a thickness of 1–2 μm. The film is cast without hardener and is then hardened by the uppermost coating composition.

The colour couplers and casting auxiliaries are entered in the following Table.

| | Component | | |
|---|---|---|---|
| | Red-sensitive | Green sensitive Emulsion Layer | Blue sensitive |
| Colour coupler | 4-Chloro-N—n-dodecyl-1-hydroxy-naphthamide (0.88 g/m$^2$) | 1-(2,4,6-tri chlorophenyl)-3-[3-(α-2,4-di-tert.-amyl-phenoxyacetamido)-benzamido]-5-pyrazolone (0.75 g/m$^2$) | 3-(2,4-di-tert.-amyl-phenoxyacetamido)-o-(4-methoxybenzoyl)-acetanilide (1.31 g/m$^2$) |
| Coating auxiliary | Sodium salt of dodecylbenzene sulphonic acid (42 mg/m$^2$) | Sodium salt of dodecylbenzene sulphonic acid (51 mg/m$^2$) | Sodium salt of dodecyl benzene sulphonic acid (67 mg/m$^2$) |
| | Sodium salt of nonylphenoxy-polyethylene-oxypropane sulphonic acid (53 mg/m$^2$) | Sodium salt of nonylphenoxy-polyethylene-oxypropane sulphonic acid (64 mg/m$^2$) | Sodium salt of nonylphenoxy polyethyleneoxy propane sulphonic acid (84 mg/m$^2$) |
| Layer thickness | 5 μm | 6 μm | 5 μm |

Samples A to I are tested by the following methods after drying:

Test 1: Glossy patches

The samples are cut up into pieces 5 cm$^2$ in area and conditioned at 30° C. and 90% atmospheric humidity for 2 days. They are then stored for one day under pressure with the photographically active side of one piece against the back of another piece. The samples are then pulled apart and the size of the area which was stuck together is assessed (blank areas in the surface).

Test 2: Extraction from cartridge

A film 35 mm in width and 125 cm in length is wound into a film cartridge and stored at 90% relative humidity and 35° C. for 7 days. The force required (g) for pulling the film out of the cartridge is then determined and recorded. The Table which follows gives the maximum value in each case. For practical purposes, the force required for extraction should not be greater than 300 g.

Test 3: Yellow patch test

The film which has been stored for Test 2 is developed photographically and examined for visible faults produced by storage, pressure and moisture. The number and size of the variously sized coloured patches is assessed in %, based on the area of film examined. A film covered with a suitable protective layer should have less than 5% of yellow patches.

Test 4: Graininess

The graininess of a photographic image is caused by the developed colour grain and by dispersions and matting agents, especially in the uppermost layers. It is determined by measuring the δ-D value with a 29 μm aperture disc as described by J. H. Altmann in Appl. Optics, Volume 3 (1964), pages 35–38. A graininess of 1.8 is the desired value for photography.

Test 5: Surface gloss

The reflection (in %) of a light beam from the surface of the layer is determined. A gelatine layer not containing any dispersed particles has a reflection of 100%.

| Sample | Test 1 (Glossy patches) in % | Test 2 (Extraction from cartridge) in g | Test 3 (Coloured patches) in % | Test 4 (graininess) δ-D value | Test 5 (Gloss before/after processing) |
|---|---|---|---|---|---|
| A | 80–90 | 1000–1500 | 20–50 | 1.8 | 96/96 |
| According to the invention: | | | | | |
| B | 10 | 150–200 | 0–5 | 1.8 | 81/99 |
| C | 10 | 200 | 0–5 | 1.7 | 80/99 |
| D | 10 | 150 | 0–5 | 1.8 | 77/99 |
| E | 10 | 200 | 0–5 | 1.9 | 89/95 |
| Comparison: | | | | | |
| F | 10 | 200–250 | 0–8 | 2.2 | 85/87 |
| G | 10 | 200–250 | 0–8 | 2.0 | 80/88 |
| H | 20–30 | 600–800 | 10–20 | 2.1 | 80/87 |
| I | 10 | 150–250 | 0–5 | 2.3 | 80/83 |

The results summarized in the above Table demonstrate the overall superiority of the characteristics of the cellulose derivatives according to the invention. Although the results achieved by some of the Comparison samples in individual tests are comparable to those achieved by the samples according to the invention, only the samples according to the invention give consistently good results in all the tests including, and this is particularly important, the graininess test. The surface gloss of the layers containing alkali soluble cellulose derivatives according to the invention is very high after processing and the graininess correspondingly low. This is evidently not solely due to the fact that the cellulose derivatives are removed in the course of alkaline processing. The effect of the larger particles in dispersions having a wide particle size distribution is particularly noticeable in Test 4. All the Comparison dispersions containing insoluble particles and having the usual particle size distribution (about ±5 μm) are found in this test to have a higher graininess. This is extremely troublesome in photographic practice, expecially in medium sensitivity colour films.

EXAMPLE 2

The effect of the cellulose derivatives according to the invention may be enhanced by the addition of colloidal silica in the form of $SiO_2$ hydrosols or by the addition of a latex of a hard polymer or copolymer having a glass transition temperature above 40° C. and a particle size below 0.5 μm, such as polymethylmethacrylate, to the composition for the protective coating. Polystyrene sulphonic acid sodium or a copolymer corresponding to the structural formula

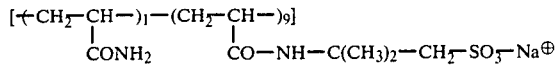

is added as a viscosity increasing agent.

The following top coating compositions are prepared:

| | 2-A | 2-B | 2-C |
|---|---|---|---|
| Gelatine solution (15% in water) | 400 g | 200 g | 400 g |
| Water (deionized) | 2800 g | 2800 g | 2800 g |
| Polystyrene sulphonic acid sodium (10% in water) | 60 g | 30 | 30 g |
| Dispersion 2 | 224 g | 224 g | 224 g |
| Silica sol, 30% in water, particle size 14 nm | — | 100 g | — |
| Polymethyl methacrylate (in latex form) 20% in water | — | — | 50 g |
| Wetting agent from Example 1, % by weight in water | 80 g | 80 g | 80 g |
| Hardener (10% by weight in water) corresponding to the formula given below | 2000 g | 2000 g | 2000 g |

The pH of the solutions is 6.5–7; wet application 50 g/m².

The hardener corresponds to the following formula

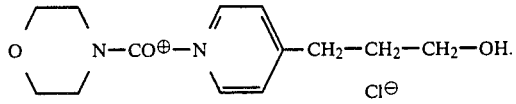

The top coating solution is cast on an unhardened colour negative film and dried.

The film is then tested as described in Example 1.

| Covering layer | Test 1 (glossy patches) in % | Test 2 (Extraction from cartridge) in g | Test 3 (Colour patches) in % | Test 4 (Graininess) δ-D value |
|---|---|---|---|---|
| 2-A | 5–10 | 150–250 | 0–3 | 1.8 |
| 2-B | 0–5 | 200 | 0 | 1.8 |
| 2-C | 0–5 | 200 | 0 | 1.9 |

Glossy patches and colour patches can be virtually completely prevented by using a combination of the cellulose derivatives according to the invention with silica sol or latex, as demonstrated by Samples B and C.

EXAMPLE 3

Comparison dispersion (3-A)

A dispersion of a porous alkali soluble substance (according to U.S. Pat. No. 4,094,848) in an aqueous gelatine solution is prepared for comparison: 20 g of gelatine are left to swell in 160 g of water and dissolved at 40° C.

0.75 g of the sodium salt of dodecylbenzene sulphonic acid dissolved in 40 g of water is added as wetting agent.

The mixture is cooled to 35° C. and a solution of 20 g of a copolymer of 63% methyl methacrylate and 37% methacrylic acid, 70 g of tert.-butanol and 70 g of ethyl acetate is then dispersed in the gelatine solution by stirring with a mixing apparatus at 1500 revs/min.

The solvent mixture is slowly evaporated off in the course of 2 hours with gentle stirring. After filtration through a filter cloth, a mixture of particles with particle sizes from 1–5 μm is obtained. The largest particles measure from 10 to 15 μm. The particles have a grained, porous surface and are opaque.

Comparison of the cellulose derivatives used according to the invention with particles of comparison dispersion 3-A The cellulose derivatives differ from the comparison particles in that they do not dissolve at a pH below 7. This is particularly advantageous for casting solutions which are required to be left to digest for some time and are adjusted to a pH of from 6.5 to 7 because certain components are not stable at pH values below 6.5. The particles according to the invention also differ from the comparison particles in that they are clear and have a smooth surface.

Comparison dispersion 3-A is incorporated in the following casting solution:

400 g of water, 70 g of a 4% aqueous solution of the wetting agent $C_7F_{15}COO^{\ominus}(NH_4)^{\oplus}$, 40 g of dispersion 3-A (10% by weight of copolymer) and 500 g of a 10% by weight aqueous hardener solution of a reaction product of a 1:1 molar reaction mixture of taurine with the compound corresponding to formula $C(CH_2—SO_2—CH=CH_2)_4$ 1:1 molar.

Dispersion 3 according to the invention is added to the following composition:

175 g of water, 70 g of a 4% by weight aqueous solution of the wetting agent $C_7F_{15}COO^{\ominus}(NH_4)^{\oplus}$, 225 g of Dispersion 3 (1.8% by weight of particles, 4 g), 500 g of the above mentioned hardener.

The casting compositions are applied to the photographically active side of an unhardened colour negative film.

Sample 3-A contains Comparison dispersion 3-A,

Sample 3-B contains Dispersion 3 according to the invention, and

Sample 3-C contains no particles of matting agent.

The pH value of all the casting solutions is in the range of 5 to 6.

Samples 3-A to 3-C are tested by the methods described in Example 1:

| Sample | Test 1 (glossy patches) in % | Test 2 (Extraction from cartridge) in g | Test 3 (colour patches) in % | Test 4 (graininess) δ-D value |
|---|---|---|---|---|
| Sample 3-A (comparison) | 5–10 | 250 | 3 | 2.0 |
| Sample 3-B (according to the invention) | 0–5 | 150 | 3 | 1.8 |
| Sample 3-C (without matting agent) | 80–90 | 900–1200 | 20–40 | 1.8 |

It is found that the particles of Sample 3-B counteract the formation of glossy patches more powerfully than the particles of the Comparison sample. The force required for extraction from the cartridge is least in Sample 3-B. The graininess of Sample 3-B is as low as that obtained in Sample 3-C without matting agent. The properties of Sample 3-B are thus clearly superior to those of the Comparison sample.

EXAMPLE 4

Test for stability at various pH values.

Dispersion 3-A and Dispersion 3 are diluted 1:100 with buffer solutions. The transparency of the solutions at various pH values is determined by means of a laser measuring arrangement (UNI-PHASE HE-Ne-Laser, thickness of cell: 1 cm: Comparison sample: distilled water = 100% transparency).

The buffer solutions have the pH values 5.5, 6.0, 6.5, 7.0, 7.5 and 8.0.

Figure 6:
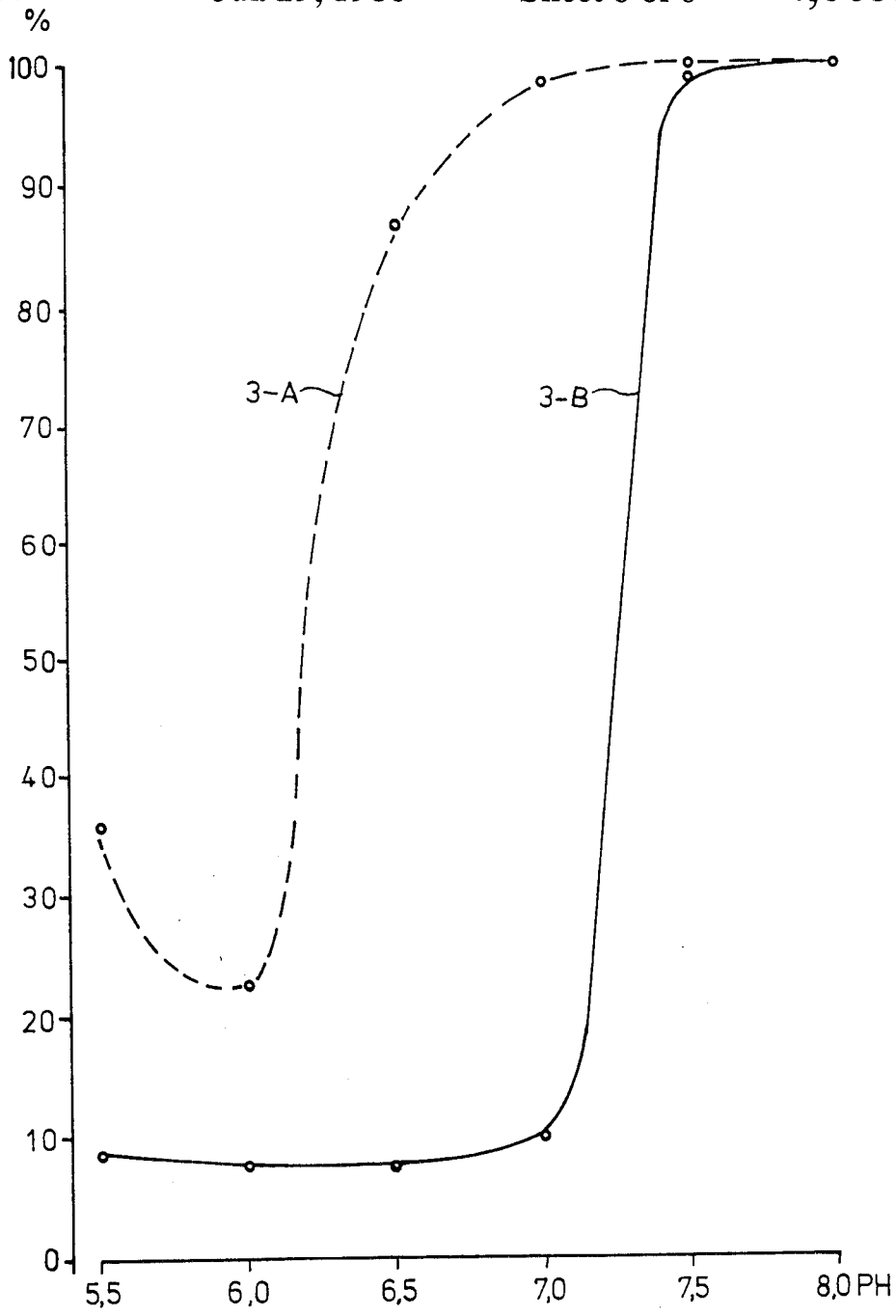

In FIG. 6, the transparency values obtained are plotted in % against the pH values.

The particles of dispersion 3-A are already dissolved at pH 6.2 and have thus lost their effect as matting agent and antiblocking agent. The particles of Dispersion 3 according to the invention are completely stable at pH values up to 7 and will not dissolve at these pH values. They are therefore considerably more useful in practice and unaffected by changes in pH in the casting solution, which is a considerable advantage.

We claim:

1. Photographic silver halide recording material in which particles smaller than 10 μm which are soluble in alkaline processing liquids are contained, dispersed in a hydrophilic colloid, in an outer transparent layer applied to the front and/or back of the material, characterised in that the layer contains, dispersed therein, from 10 to 500 mg/m² of spherical transparent particles of a hydroxyalkyl-alkyl cellulose dicarboxylic acid semiester having a particle size of from 0.5 to 8 μm and a particle size distribution of up to ±2 μm.

2. Material according to claim 1, characterised in that it contains a hydroxyalkyl-alkyl cellulose dicarboxylic acid semi-ester containing the group $R_m^1R_n^2R_p^3A$ wherein A denotes a glucose residue of the cellulose, $R^1$ denotes a hydroxyalkyl group having 2 to 4 carbon atoms, $R^2$ denotes an alkyl group having 1 to 3 carbon atoms, $R^3$ denotes the monoacyl group of a benzene dicarboxylic acid or of such an acid in a partially or completely hydrogenated form, m = 0.2–1.0, n = 0.8–2.0 and p = 0.5–1.5, where $m \neq n \neq p$ and the sum of m+n+p is at the most 3.

3. Material according to claim 1, characterised in that the hydroxyalkyl-alkyl cellulose dicarboxylic acid semiester is a hydroxypropyl-methyl cellulose-hexahydrophthalic acid semiester or a hydroxypropyl-methyl cellulose-phthalic acid semiester.

4. Material according to claims 1 or 2, characterised in that the layer in addition contains colloidal silica with a particle size of less than 0.15 μm in a quantity of from 0.5 to 2 parts by weight, based on 1 part by weight of the hydrophilic colloid.

5. Material as in any one of claims 1 to 3, characterised in that the layer in addition contains particles of a homo- or copolymer having a glass transition temperature of at least 40° C. and a particle size of less than 0.1 μm, in a quantity of up to 50% by weight, based on the hydrophilic colloid.

* * * * *